United States Patent [19]

Burdette et al.

[11] 4,103,728

[45] Aug. 1, 1978

[54] MEMBRANE MOUNTING SYSTEM FOR WINDOWS

[76] Inventors: Robert E. Burdette, 2032 Verde Ave., Akron, Ohio 44314; Aubrey M. Fuller, 5832 Spikerman Dr., Clinton, Ohio 44216

[21] Appl. No.: 794,470

[22] Filed: May 6, 1977

[51] Int. Cl.[2] ..... E06B 3/00

[52] U.S. Cl. ..... 160/368 R; 160/354; 160/392

[58] Field of Search ..... 160/330, 354, 368 R, 160/369, 371, 392

[56] References Cited

U.S. PATENT DOCUMENTS

| | | | |
|---|---|---|---|
| 3,205,547 | 9/1965 | Riekse | 160/330 |
| 3,251,399 | 5/1966 | Grossman | 160/354 |
| 3,371,702 | 3/1968 | Keegan et al. | 160/392 |
| 3,991,806 | 11/1976 | Abell | 160/354 |

FOREIGN PATENT DOCUMENTS

| | | | |
|---|---|---|---|
| 1,309,720 | 3/1973 | United Kingdom | 160/330 |

*Primary Examiner*—Peter M. Caun
*Attorney, Agent, or Firm*—Sidney W. Millard

[57] ABSTRACT

A system for mounting thin transparent membrane material over the interior of a window to provide an insulating effect. An elongate narrow retainer molding is positioned along the peripheral frame portion of the window. This molding includes a narrow base portion having a flat surface intended for adhesive and permanent attachment to the frame. Integrally formed with the base portion are two side components which extend upwardly to a top surface which is shaped concavely to define a receiving region. Detents are formed in these side portions which extend over a centrally disposed groove. A beading of circular cross-section is urged with the peripheral portion of the membrane into the centrally disposed groove to provide a non-adhesive form of fixation of the membrane to the retainer molding. By selection of relative dimensions of the molding, the centrally disposed groove remains continuous about the entire window mounting even though the orientation of retainer molding components across corners may be transverse.

7 Claims, 8 Drawing Figures

MEMBRANE MOUNTING SYSTEM FOR WINDOWS

BACKGROUND

With restrictions in the availability of heating fuels, the inhabitants of older and leased dwellings have looked to inexpensive techniques for minimizing heating energy demands. One popular technique utilized in this conservation effort has been to cover windows with an inexpensive membrane or thin transparent sheet material formed of polyvinyl chloride and like plastic materials. Generally, such sheets or membranes are installed at the interior facing side of a window, the fragile nature of the material not being capable of withstanding rigorous weather conditions as are encountered outside of the window.

Attachment of the membrane material to peripherally disposed window frames generally has been carried out with the most expedient means available, usually an adhesive carrying tape. While this form of mounting has a short term effectiveness, it is considered to be unsightly. Further, with the unavoidable development of condensation around the windows, the membrane retaining tape tends to loosen, thus to cause inconvenience as well as to derrogate from the insulation effectiveness otherwise available with the arrangement. At the termination of the winter season, in most situations, the tape and membrane are removed and disposed of. Such disposal is necessary, inasmuch as the tape is effective only on a one time basis and cannot be removed from the membrane. During the removal procedures as the tape is pulled off of the window frame, particles of surface paint very often are removed with it to mar the appearance of the window and necessitate refinishing.

SUMMARY

The present invention is addressed to a system for mounting thin, flexible membrane material over a window. This system has the attributes of permitting a simplified mounting procedure utilizing a unique retainer molding. The molding is configured for permanent installation upon the peripherally disposed frame of the window, however, it functions to retain the membrane even while remaining so small in size as to be unobtrusive, not detracting from the aesthetic appearance of the window. Retained within the molding through the use of a circular beading insertable within a detent surmounted elongate groove, the insulating membrane readily is removable from the window at the end of a season of use without damage. Accordingly, all of the components from the system may be reused from year to year.

The invention further contemplates a system for mounting a flexible membrane over the interior of a window which includes an elongate, narrow retainer molding extensible along a substantial portion of the frame periphery. This molding includes a narrow base portion, i.e. having a width less than one half inch, having a flat outwardly disposed connecting surface for positioning the molding adjacent the window frame. Such positioning readily may be provided through the use of a paper covered adhesive tape one surface of which is permanently attached to the flat surface of the molding. The molding incorporates two side components formed integrally with the base portion and having mutually oppositely disposed side surfaces which are spaced to define an elongate central groove. The top surface of each of the side components are configured to slope toward the groove at an acute angle to provide a concave self-aligning receiving region considerably facilitating the mounting of membrane over the molding. The component top surfaces further are configured to extend over the side surfaces of the groove to define detents which readily retain the noted beading. Removal of the membrane following a season of use is simply carried out by removing the beading and storing it with the membrane for use in a succeeding winter season.

Other objects of the invention will, in part, be obvious and will, in part, appear hereinafter.

The invention, accordingly, comprises the system and apparatus possessing the construction, combination of elements and arrangement of parts which are exemplified in the following detailed disclosure. For a fuller understanding of the nature and objects of the invention, reference should be had to the following detailed description taken in connection with the accompanying drawings.

DETAILED DESCRIPTION

Figure 1:
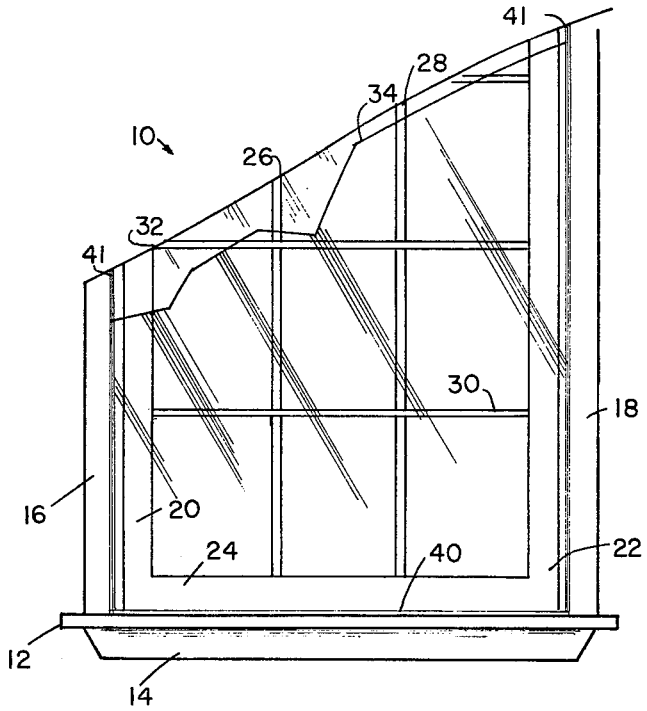
FIG. 1 is a front elevational view of a window with a membrane mounted over the interior facing side thereof utilizing the system of the invention, portions being broken away in the interest of clarity.

Referring to FIG. 1, a conventional window installation as may be found in a dwelling or the like is revealed in partial, broken away fashion. The view is considered to be from the inside of the dwelling in which the window 10 is installed and reveals a conventional sill 12 supported by horizontal lower molding 14. Additional trim such as upstanding members 16 and 18 also are peripherally disposed as a frame about the window. Not shown is a horizontal return portion extending across the top of a window installation. The window itself may be of any conventional type, that being illustrated having vertically oriented frame members 20 and 22 and a lower horizontal cross member 24. These components support typical mullions as at 26 and 28 as well as similar light dividing bars 30 and 32. Window 10 is shown covered by a thin membrane formed of sheet plastic, for example polyvinyl chloride (PVC) as is represented at 34. Membrane 34 is attached to the outer frame members 16 and 18 as well as sill 12 through the use of a horizontally extending retainer molding 40 and vertically extending retainer moldings 41 and beading assembly 43, the retainer moldings being adhesively attached to the peripheral framing members 14, 16 and 18. Generally the moldings 40 and 41 are formed by extrusion having a base dimension, *w*, of less than one half inch, for example 0.400 inch and serve to retain membrane 34 in position such that it is an air-tight connection around the entirety of the peripheral frame of the window 10. The very small base size permitted with the particular retainer molding 40, 41 does not detract from the aesthetic appearance of the window, particularly during seasonal periods when membrane 34 is not installed. Generally, the thickness chosen for membrane 34 is 0.001 or 0.004 inch.

Figure 2:
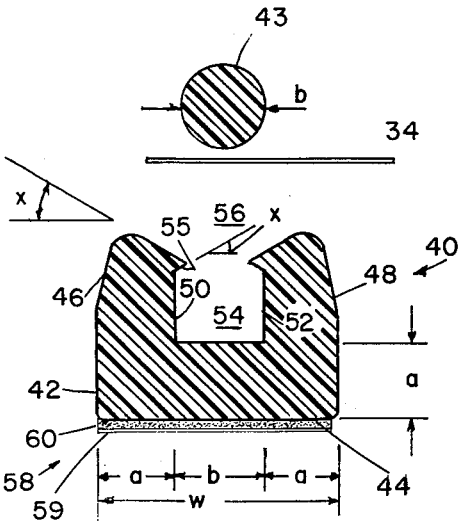
FIG. 2 is an enlarged and exploded sectional view of apparatus used with the system of the invention.
Figure 3:
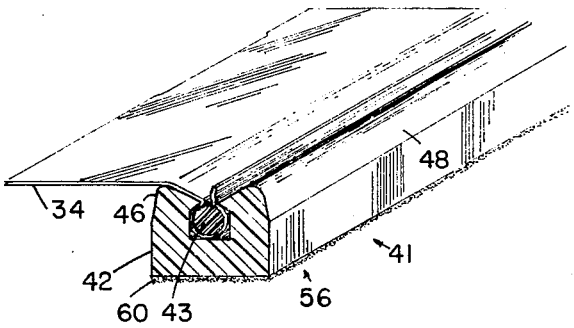
FIG. 3 is an enlarged perspective view of an elongate retainer molding, membrane and beading utilized with the system of the invention.
Figure 7:
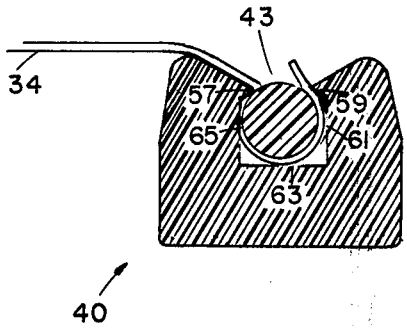
FIG. 7 is an enlarged sectional view of the molding membrane and beading illustration the five points of frictional holding engagement.

Looking to FIGS. 2, 3, and 7 the elongate, narrow retainer molding 40 is revealed in enlarged detail. Molding 40 is configured having a narrow base portion 42 of a thickness represented in the drawing as "*a*". Base portion 42 further is characterized in having a flat outwardly disposed connecting surface 44, shown having a width designated "*w*". This width "*w*" is selected as being relatively narrow with respect to the conventional dimensioning of a window 10. Preferably, the width is selected as about the above-noted 0.400 inch. While providing suitable support for the retaining function of the system, this width is found to be such as not to adversely effect the aesthetic appearance of the window about which molding 40 is mounted. Formed integrally with base 42 and extending upwardly therefrom are side components 46 and 48 which are formed having mutually inwardly disposed opposed side surfaces shown respectively at 50 and 52. Surfaces 50 and 52 are spaced to define an elongate centrally disposed groove 54. This groove has a width represented in FIG. 2 as "*b*". The thickness of the lower portions of side components 46 and 48 measured horizontally in FIG. 2 adjacent to the bottom of groove 54 are exactly equivalent to the thickness of base portion 42 measuring from 44 to the bottom of groove 54 designated earlier as "*a*". These equivalent dimensions are important to the versatility of the mounting system as will be explained subsequently.

Looking to the outer surfaces of components 46 and 48, it may be noted that they cant or slope slightly inwardly at an angle of about 10° with the vertical and extend symmetrically to an uppermost portion of molding 40. From that uppermost portion, the top surfaces of each of components 46 and 48 are configured to slope toward groove 54 at an angle of about 30° with the horizontal, or surface 44, that angle being designated in FIG. 2 as "*x*". This acute angle serves to define a concave, self-aligning receiving region or mouth, represented generally at 56. This region will be seen to considerably aid in the installation of membrane 34. The surfaces of side components 46 and 48 further are configured to extend a slight distance over the side surfaces 50 and 52 of groove 54 to define detents 55. The lower surfaces of those detents are angled at a corresponding angle of about 30°, also designated as "*x*" on the drawing to provide a pair of frictional pressure holding points 57 and 59 (see FIG. 7) when the membrane is in place and provide a slope toward mouth 56 to facilitate removal of the bead 43 in the springtime of the year, 30° on the detent being preferred.

Moldings 40 and 41 preferably are constructed incorporating an adhesive underlay which is attached to bottom surface 44. This underlay is represented at 58 as having a paper base 59 and an adhesive coating thereover, 60. Accordingly, to mount the molding, the paper overlay is removed to expose coating 60, whereupon the molding is applied by contact to the peripheral frame portions of window 10.

FIG. 2 additionally shows, in exploded fashion, a fragment of membrane 34 positioned over region 56 as well as an elongate beading 43 formed of the same resilient plastic as is utilized to form molding 40. Beading 43 has a diameter equal to or slightly exceeding the spacing of side surfaces 50 and 52 of groove 54 and designated earlier as "*b*". The attachment of membrane 34 is carried out by positioning the periphery thereof over region 56, whereupon beading 43 is pressed into groove 54 until the upward surface portions thereof fall beneath the under surfaces of the detents 55 within side components 46 and 48. This arrangement provides for a desirably strong connection, promotes a proper pensioning of membrane 34 across window 10 and requires no adhesive materials or the like. As is apparent, inasmuch as beading 43 is generally continuous in length about the periphery of window 10, insulating quality of the membrane mounting is enhanced. The bead is gripped firmly at five frictional points 57, 59, 61, 63, 65 within groove 54 (see FIG. 7) to insure that a minimum of air will pass from outside the room to inside the room.

Following the positioning of beading 43 within groove 54, any surplusage portion of membrane 34 which may protrude into region 56 is simply trimmed with a sharp tool to derive a neat and non-detracting mounting arrangement. Reference is made to FIG. 3 to show a fragmentary portion of such mounting arrangement.

Figure 4:
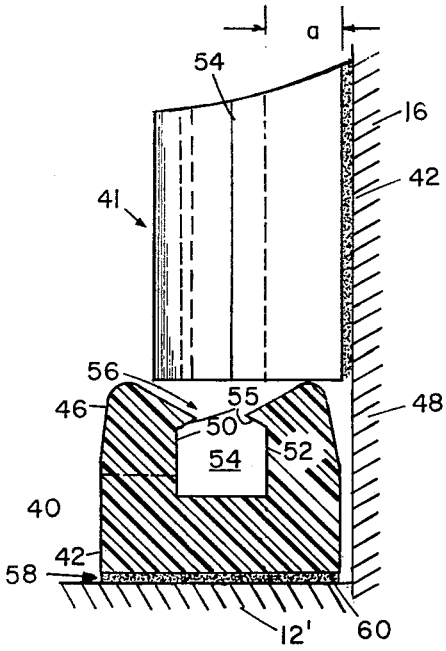
FIG. 4 is a partial sectional view of the retainer molding of the system of the invention showing the geometry thereof at a window corner where the mouth of the vertical molding groove is facing toward the room and the mouth of the horizontal molding groove faces the ceiling.
Figure 5:
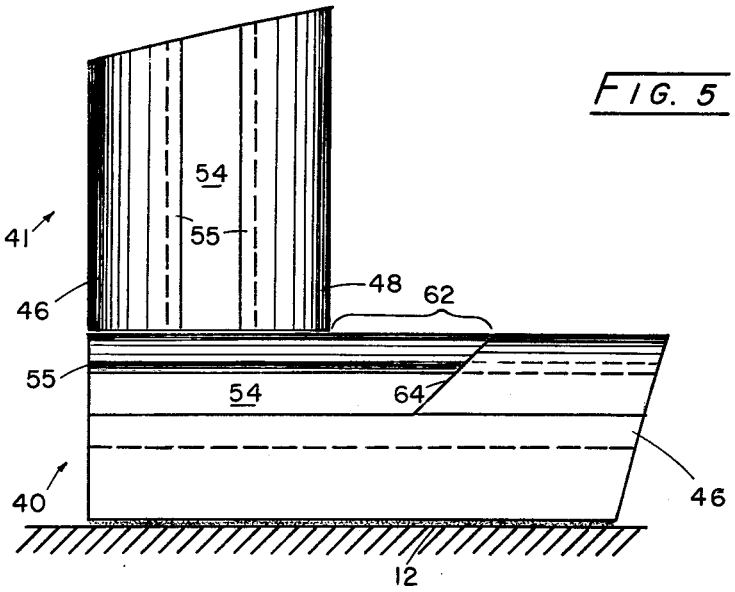
FIG. 5 is a fragmentary elevational view of the corner joint of FIG. 4.

Looking to FIGS. 4 and 5, the interrelationship of molding portions 40 and 41 at the corner junctions thereof between, for example, sill 10 and frame 16 (FIG. 1) is revealed. As noted earlier, the thickness of base portion 42, designated "*a*" is made equivalent to the thickness of the adjoining portion of side components 46 and 48. With such an arrangement, the continuity of groove 54 entirely about the window mounting is assured where the arrangement of sill and frame are such that the mouths 56 of moldings 40 and 41 are not oriented in the same direction. As shown in FIG. 5, by notching, for example, that portion of molding 40 affixed to frame component 16 at the corner the horizontally and vertically oriented moldings are uniquely joined such that beading 43 may be continuous around the corner to assure a proper fitting of membrane 34 even though the moldings 40 and 41 are oriented transversely to each other. The "notching" comprises severing the end portion of component 46 of moldng 40 such that bead 41 can be pressed into the groove in molding 40 and bend around component 48 into the groove in molding 41. Inherently, the spacing 62 between the slanted cut 64 and molding 41 must be greater than the diameter of bead 43.

As noted above, at the conclusion of a winter season of use, beading 43 simply is removed from groove 54 and the undamaged membrane 34 may be rolled or folded for a subsequent season's use. However, moldings 40 and 41, by virtue of their small dimensions remain fixed to window 10 in unobtrusive fashion.

The type of material utilized in forming moldings 40 and 41 as well as beading 43 may vary to suit particular needs, however, it has been found that the molding and beading may be extruded from a PVC plastic generally identified as "90 Durometer PVC".

Figure 6:
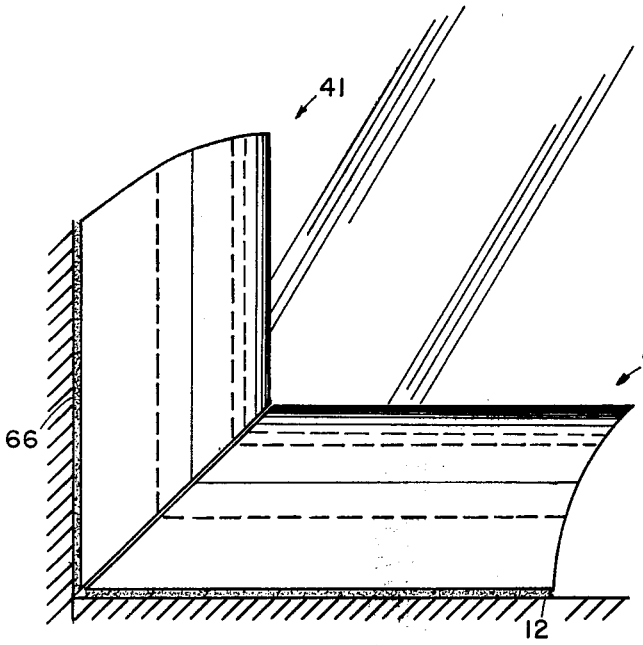
FIG. 6 is a fragmentary elevational view of an alternative corner joint where the mouths of the grooves are both facing inward toward the window pane.

Considering now FIG. 6, it will be observed that molding 40 is oriented as before except that the end is cut at a 45° angle. However, molding 41 has been rotated to the right 90° and its abutting end is also cut at 45°. This can be done in cases where the window framing is such that the upstanding members at the sides of the window include a projection 66 extending generally perpendicular to the window pane. In such a case the moldings 40 and 41 can be cut at a 45% angle and the groove pattern of one molding will mesh with the groove pattern of the other without any problem. Note that the upstanding members 16 and 18 in FIGS. 1, 4 and 7 extend parallel with the window pane and therein lies the versatility of the moldings which have the unique dimensions which allow one molding at a joint to be rotated 90°, 180°, or 270° and still the groove of one will coincide with the other. The molding can be glued on almost any existing framed window without substantial modification.

Since certain changes may be made in the above described system and apparatus without departing from the scope of the invention herein involved, it is intended that all matter contained in the description thereof or shown in the accompanying drawings shall be interpreted as illustrative and not in a limiting sense.

I claim:

1. A system for mounting a thin, flexible membrane over the interior of a window having a peripherally disposed angular frame mounted in a plane comprising:

an elongate, narrow retainer molding extensible along a substantial portion of said frame for defining an angular geometric shape generally corresponding to the window frame, said retainer molding including a narrow base portion having a flat, outwardly disposed connecting surface for positioning adjacent said frame;

first and second elongate side components formed integrally with and extending from said base portion and having mutually inwardly disposed opposed side surfaces spaced to define an elongate central groove having a width *b*, the top surface of each said first and second side component being configured to slope toward said groove at an acute angle with respect to said connecting surface to define a concave self-aligning receiving region;

said first and second side component top surfaces further being configured to extend a given distance over each said side surface to define detent means;

means for connecting said retainer molding to said frame such that said flat base portion connecting surface abuts against the surface of said frame;

resilient beading means having a circular cross-section of diameter corresponding to the width *b* of said groove for positioning over a peripheral portion of said membrane and subsequent insertion thereof into said groove and whereby extraction from said groove is arrested by said detent means; and said first and second side components are configured having substantially equivalent thicknesses with each other and with said flat base, the angular geometric shape defined by the frame and the molding including at least three angles and the molding defining the geometric shape being formed by at least three separate pieces, the receiving region of one of said pieces having a first orientation with respect to the plane of said frame and the receiving region of both the other pieces being oriented orthogonal to the first named piece;

the pieces being in abutting relationship at the angles and the resilient beading at a constant elevation with respect to the plane of the frame completely around the frame.

2. The system of claim 1 wherein said connecting means comprises an adhesive surface fixed to said flat, outwardly disposed connecting surface of said retainer molding base portion.

3. The system of claim 1 wherein said acute angle slope of said first and second side component top surfaces is about 30°.

4. The system of claim 1 wherein the spacing between the lowermost surface of said detent means is less than said resilient beading means diameter.

5. The system of claim 1 in which each said first and second side component detent means is configured having a lowermost surface extending from respective said side surfaces and sloping upwardly from said groove at an acute angle with respect to said connecting surface.

6. The system of claim 1 wherein said retainer molding and said resilient beading means are formed of a resilient polymeric material.

7. The system of claim 1 wherein the relative shapes and sizes of the groove and beading combining to provide at least five opposed points of frictional contact with the membrane which is held therebetween.

* * * * *